US009324306B2

(12) United States Patent
Hoshino et al.

(10) Patent No.: US 9,324,306 B2
(45) Date of Patent: Apr. 26, 2016

(54) KEYBOARD DEVICE AND KEYBOARD INSTRUMENT

(71) Applicant: CASIO COMPUTER CO., LTD., Shibuya-ku, Tokyo (JP)

(72) Inventors: Akihisa Hoshino, Fussa (JP); Hirokazu Taniguchi, Tachikawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/834,128

(22) Filed: Aug. 24, 2015

(65) Prior Publication Data

US 2016/0071498 A1 Mar. 10, 2016

(30) Foreign Application Priority Data

Sep. 8, 2014 (JP) ..... 2014-182530
Mar. 6, 2015 (JP) ..... 2015-044949

(51) Int. Cl.
*G10C 3/12* (2006.01)
*G10C 3/18* (2006.01)

(52) U.S. Cl.
CPC ... *G10C 3/12* (2013.01); *G10C 3/18* (2013.01)

(58) Field of Classification Search
CPC ..... G10C 3/12; G10C 3/125; G10H 1/346; G10H 1/344; G10H 1/32; G10H 1/0016; G10H 2220/265; G10D 13/085; H01H 13/85; H01H 13/86; H01H 2215/05; H01H 2215/052; H01H 2221/05; H01H 2221/062
USPC ..... 84/423 R, 433–438
See application file for complete search history.

(56) References Cited

U.S. PATENT DOCUMENTS 5,986,202 A * 11/1999 Seiler ..... G10H 1/346 84/18
6,472,589 B1 * 10/2002 Lee ..... G01F 1/02 84/21
6,683,242 B2 1/2004 Inoue et al.

FOREIGN PATENT DOCUMENTS

JP 2002258835 A 9/2002

* cited by examiner

*Primary Examiner* — Kimberly Lockett
(74) *Attorney, Agent, or Firm* — Holtz, Holtz & Volek PC

(57) ABSTRACT

A keyboard device including a plurality of transmission members which are provided corresponding to a plurality of keys arranged in parallel and each of which makes a rotating motion in response to a depression operation on a corresponding key, a plurality of hammer members which are provided corresponding to the plurality of keys and each of which makes a rotating motion in response to the rotating motion of the transmission member and thereby provides an action load to the key, and a plurality of interlock control sections each of which controls the rotating motion of the hammer member made in response to the rotating motion of the transmission member by a relative motion of an interlock projecting section of the transmission member with respect to a guide hole provided in the hammer member.

20 Claims, 9 Drawing Sheets

KEYBOARD DEVICE AND KEYBOARD INSTRUMENT

CROSS-REFERENCE TO RELATED APPLICATION

This application is based upon and claims the benefit of priority from the prior Japanese Patent Applications No. 2014-182530, filed Sep. 8, 2014 and No. 2015-044949, filed Mar. 6, 2015, the entire contents of which are incorporated herein by reference.

BACKGROUND OF THE INVENTION

1. Field of the Invention

The present invention relates to a keyboard device for use in a keyboard instrument such as a piano, and a keyboard instrument including the keyboard device.

2. Description of the Related Art

For example, a keyboard device such as a piano is known which includes a wippen that rotates by a key depression operation, a jack that is driven in response to the rotating motion of the wippen, and a hammer member that is driven by the jack and strikes a string such that these components are provided corresponding to a plurality of keys, as described in Japanese Patent Application Laid-Open (Kokai) Publication No. 2002-258835.

This type of keyboard device further includes a braking member that brakes the motion of the hammer member after the hammer member is driven by the jack driven in response to the rotating motion of the wippen by a key depression operation and strikes a string. After the string is stricken by the hammer member, the motion of the hammer member is once stopped by the braking member, whereby double strikes on the string by the bounceback of the hammer member that has stricken the string can be prevented.

However, in the structure of this keyboard device where the motion of the hammer member is once stopped by the braking member after the hammer member strikes a string, accurate motion timing and high motion accuracy of the braking member are required. Thus, this keyboard device has problems in that the structure of the braking member is complicated, manufacturing and assembling works for the braking member are burdensome, and the size of the instrument as a whole is increased due to the necessity of an installation space for the braking member.

SUMMARY OF THE INVENTION

The present invention is to provide a downsized keyboard device having a simple structure which is capable of inhibiting an unnecessary motion of a hammer member, and a keyboard instrument including this keyboard device.

In accordance with one aspect of the present invention, there is provided a keyboard device comprising: a plurality of keys; and action mechanisms respectively provided corresponding to the plurality of keys, wherein each action mechanism comprises a transmission member which is displaced in response to a depression operation on a corresponding key; a hammer member which provides an action load to the key subjected to the depression operation by making a motion in response to the displacement of the transmission member; and an interlock control section which has an interlock projecting section provided to one of the transmission member and the hammer member and a guide section which guides the interlock projecting section, and is provided to another one of the transmission member and the hammer member, for controlling the motion of the hammer member made in response to the displacement of the transmission member corresponding to the key subjected to the depression operation by a relative motion between the guide section and the interlock projecting section.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 4A and FIG. 4B are diagrams showing portions of the transmission member and a transmission holding member depicted in FIG. 3, of which FIG. 4A is an enlarged planar view thereof and FIG. 4B is an enlarged sectional view of the main portion taken along line B-B in FIG. 4A;

FIG. 6A and FIG. 6B are diagrams showing portions of the hammer member and a hammer holding member depicted in FIG. 3, of which FIG. 6A is an enlarged planar view thereof and FIG. 6B is an enlarged sectional view of the main portion taken along line C-C in FIG. 6A;

FIG. 8A, FIG. 8B, and FIG. 8C are diagrams showing the interlock control section depicted in FIG. 3, of which FIG. 8A is an enlarged sectional view of the interlock control section taken along line D-D in FIG. 3, FIG. 8B is an enlarged side view of an interlock projecting section of the interlock control section, and FIG. 8C is an exploded and enlarged side view of the interlock projecting section.

DETAILED DESCRIPTION OF THE PREFERRED EMBODIMENT

Hereafter, an embodiment in which the present invention has been applied in an electronic keyboard instrument is described with reference to FIG. 1 to FIG. 9.

Figure 1:
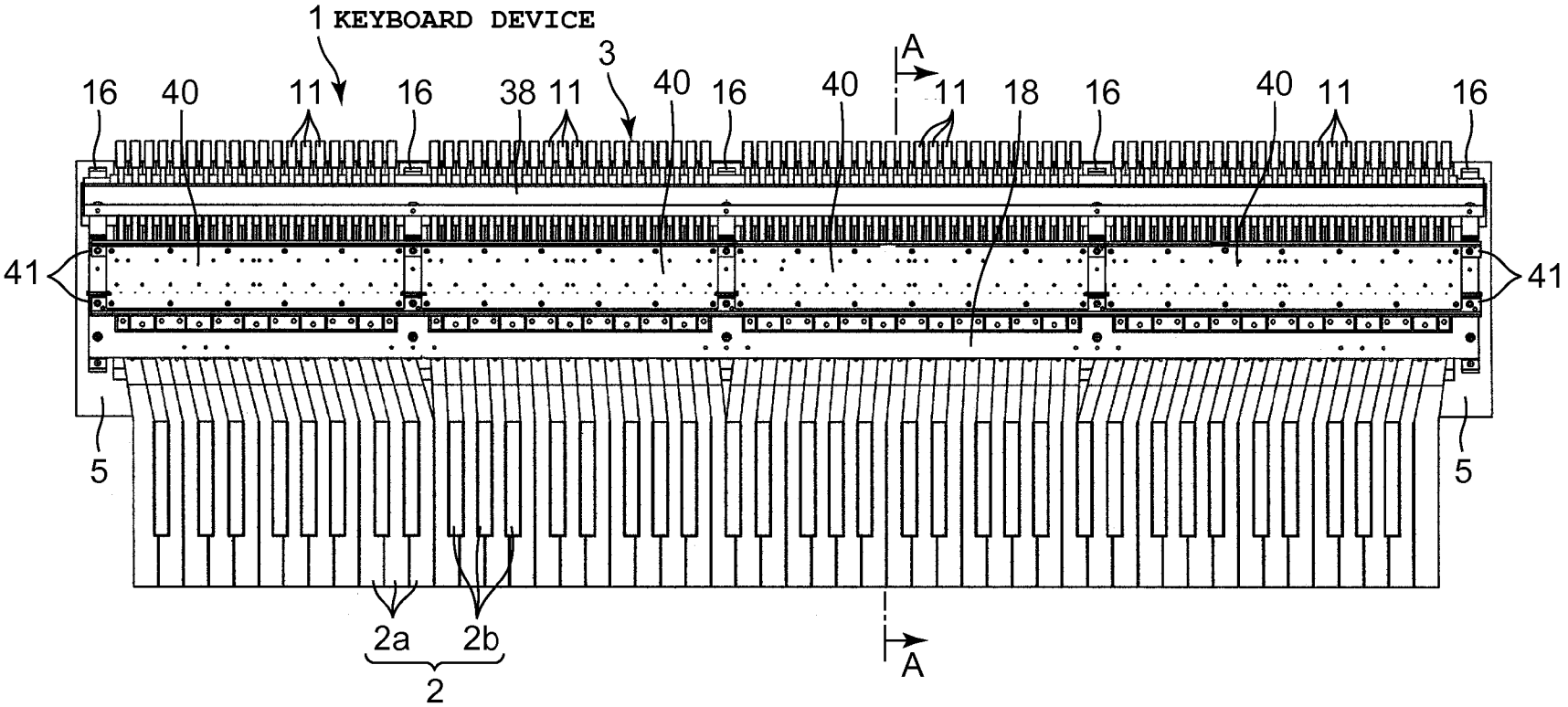
FIG. 1 is a planar view of a keyboard device in an embodiment where the present invention has been applied in an electronic keyboard instrument.
Figure 2:
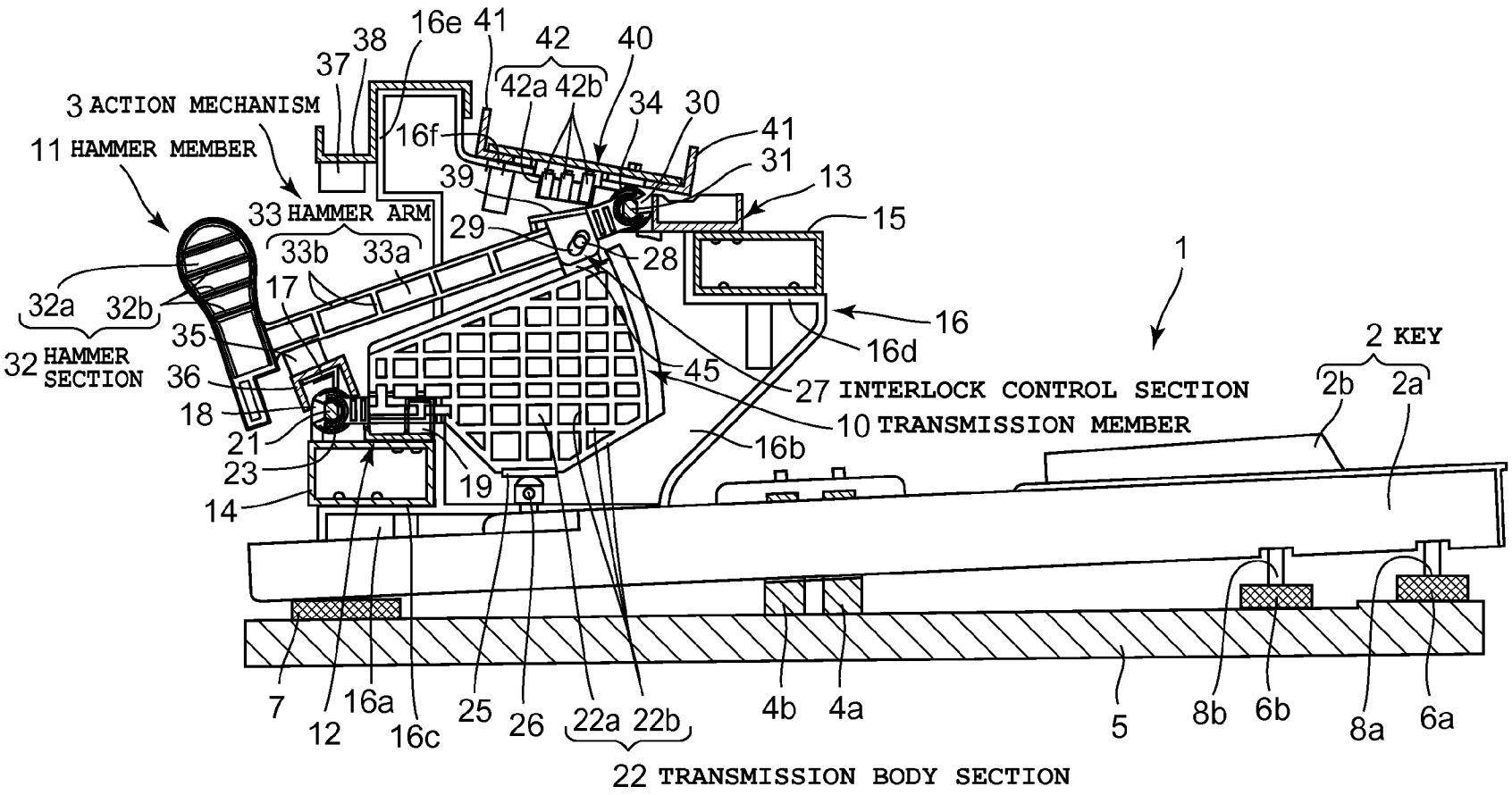
FIG. 2 is an enlarged sectional view of the keyboard device taken along line A-A in FIG. 1.

The electronic keyboard instrument includes a keyboard device 1 as depicted in FIG. 1 and FIG. 2. This keyboard device 1, which is mounted inside an instrument case (not depicted), includes a plurality of keys 2 arranged in parallel and action mechanisms 3 each of which provides an action load to a corresponding key 2 of the plurality of keys 2 in response to a key depression operation.

The plurality of keys 2 have white keys 2*a* and black keys 2*b* as depicted in FIG. 1 and FIG. 2. These white keys 2*a* and black keys 2*b*, eighty eight in total, are arranged in parallel. Each of the plurality of keys 2 is supported by balance pins 4*a* and 4*b* at a substantially intermediate portion in the front and rear direction (in FIG. 2, the lateral direction) of the key so as to be rotatable in the vertical direction and, in this state, these keys 2 are arranged in parallel on a base plate 5.

On the base plate 5, cushion members 6*a* and 6*b* with which the lower surface of the front end portion (in FIG. 2, the right end portion) of each key 2 separably comes in contact are provided along the array direction of the keys 2, as depicted in FIG. 2. Also, on the base plate 5, a cushion member 7 with which the lower surface of the rear end portion (in FIG. 2, a left end portion) of each key 2 separably comes in contact is provided along the array direction of the keys 2. Moreover, on the base plate 5, guide pins 8*a* and 8*b* for preventing the rolling of the plurality of keys 2 in their array direction are provided upright.

Figure 3:
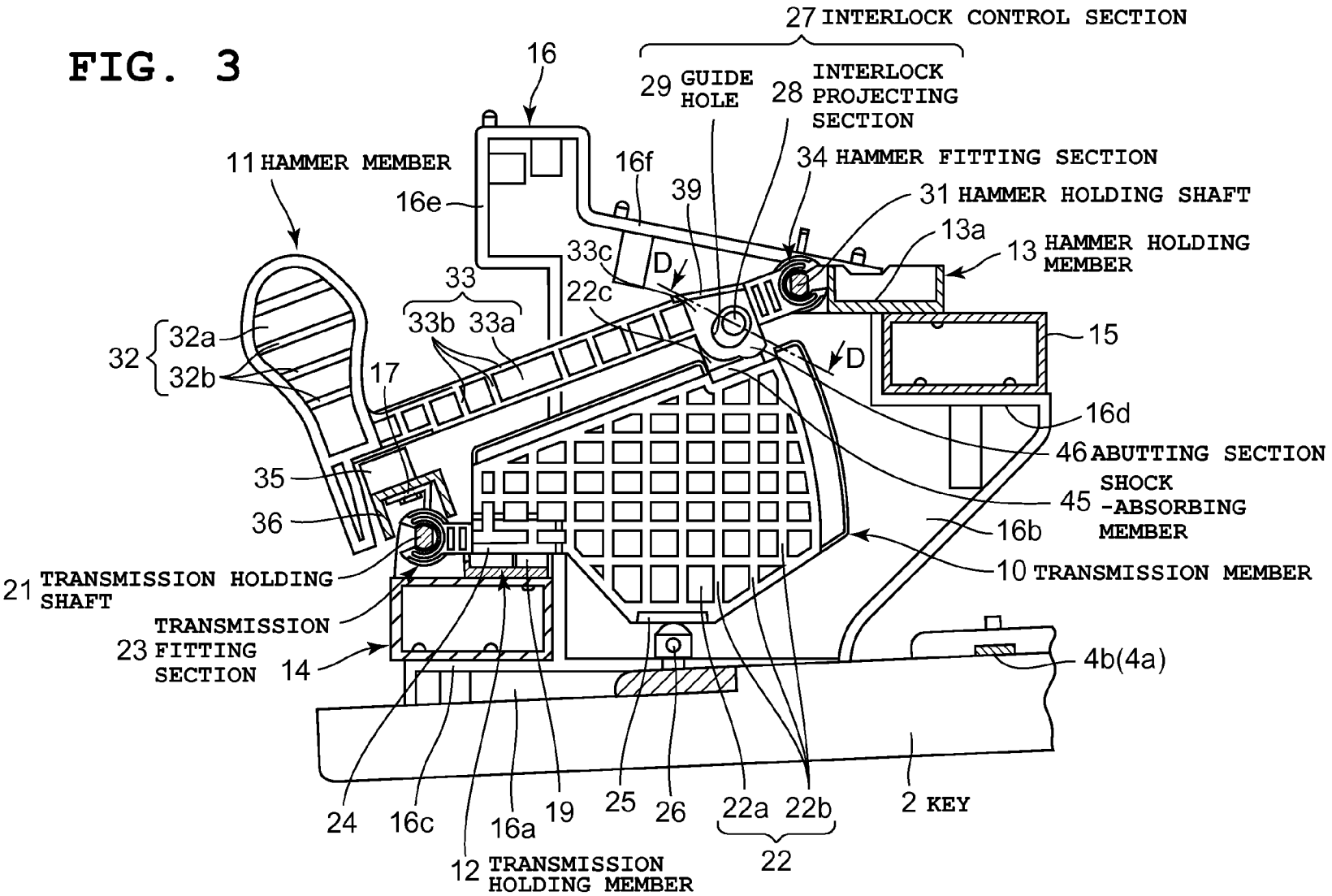
FIG. 3 is an enlarged sectional view of the main portion of the keyboard device depicted in FIG. 2, in which a transmission member and a hammer member arranged above a key are interlockably coupled together by an interlock control section.

The action mechanisms 3 each include a plurality of transmission members 10 each of which rotates in the vertical direction in response to a key depression operation on a corresponding one of the plurality of keys 2, and a plurality of hammer members 11 each of which rotates in the vertical direction in accordance with the rotating motion of a corresponding one of the plurality of transmission members 10 and thereby provides an action load to a corresponding one of the plurality of keys 2, as depicted in FIG. 1 to FIG. 3. In this embodiment, the plurality of keys 2 are each structured to be rotated in the counterclockwise direction around the balance pins 4*a* and 4*b* by the weight of a corresponding one of the plurality of transmission members 10 and the weight of a corresponding one of the plurality of hammer members 11, and pressed up to an initial position, so that an initial load is provided thereto.

This action mechanism 3 also includes a plurality of transmission holding members 12 each of which rotatably holds a corresponding one of the plurality of transmission members 10 and a plurality of hammer holding members 13 each of which rotatably holds a corresponding one of the plurality of hammer members 11, as depicted in FIG. 2 and FIG. 3. The plurality of transmission holding members 12 are mounted on transmission support rail 14 arranged along the array direction of the keys 2. Also, the plurality of hammer holding members 13 are mounted on a hammer support rail 15 arranged along the array direction of the keys 2. These transmission support rail 14 and hammer support rail 15 are supported by a plurality of support members 16 and arranged above the plurality of keys 2.

The plurality of support members 16 are mounted upright on the base plate 5 and positioned in a plurality of areas defined in advance over the entire length of the keys 2 in the arrangement direction. Here, the number of the arranged keys 2 is, for example, eighty eight in total. Accordingly, the plurality of support members 16 are arranged at both ends of the plurality of keys 2 in the array direction and three areas located at every twenty keys. That is, in the present embodiment, the plurality of support members 16 are arranged in five areas over the entire length of the keys 2 in the array direction.

The support members 16 are made of hard synthetic resin such as ABS (Acrylonitrile Butadiene Styrene) resin, and each of them has a support member mount section 16*a* mounted on the base plate 5 and a bridge section 16*b* integrally formed on the support member mount section 16*a*, as depicted in FIG. 2 and FIG. 3. By the support member mount section 16*a* being mounted on the base plate 5, the support member 16 is structured to be arranged between rear portions of the plurality of keys 2 with the bridge section 16*b* projecting above the key 2.

Here, a lower portion of the rear end of the bridge section 16*b*, that is, an upper portion on the rear side (in FIG. 2, an upper portion on the left) of the support member mount section 16*a* is provided with a rear-side rail support section 16*c* which supports the transmission support rail 14, as depicted in FIG. 2 and FIG. 3. Also, an upper portion on the front side (in FIG. 2, an upper portion on the right) of the bridge section 16*b* is provided with a front-side rail support section 16*d* which supports the hammer support rail 15. Moreover, an upper portion on the rear side (in FIG. 2, an upper portion on the left) of the bridge section 16*b* is provided with a stopper rail support section 16*e*, and an upper portion of the bridge section 16*b* is provided with a substrate rail support section 16*f*.

The transmission support rail 14 is formed in a rectangular square tube shape in cross section and has a length corresponding to the entire length of the plurality of keys 2 in the array direction, as depicted in FIG. 2 and FIG. 3. The transmission support rail 14 is structured such that predetermined portions thereof in the array direction of the keys 2 are mounted on the rear-side rail support sections 16*c* of the plurality of support members 16.

On the transmission support rail 14, the plurality of transmission holding members 12 and a plurality of stopper support sections 17 are mounted along the array direction of the keys 2, as depicted in FIG. 2 and FIG. 3. Here, the plurality of stopper support sections 17 are made of metal plates, and are mounted in five areas on the transmission support rail 14 corresponding to the plurality of support members 16 with them projecting above the plurality of transmission holding members 12.

Figure 4A:
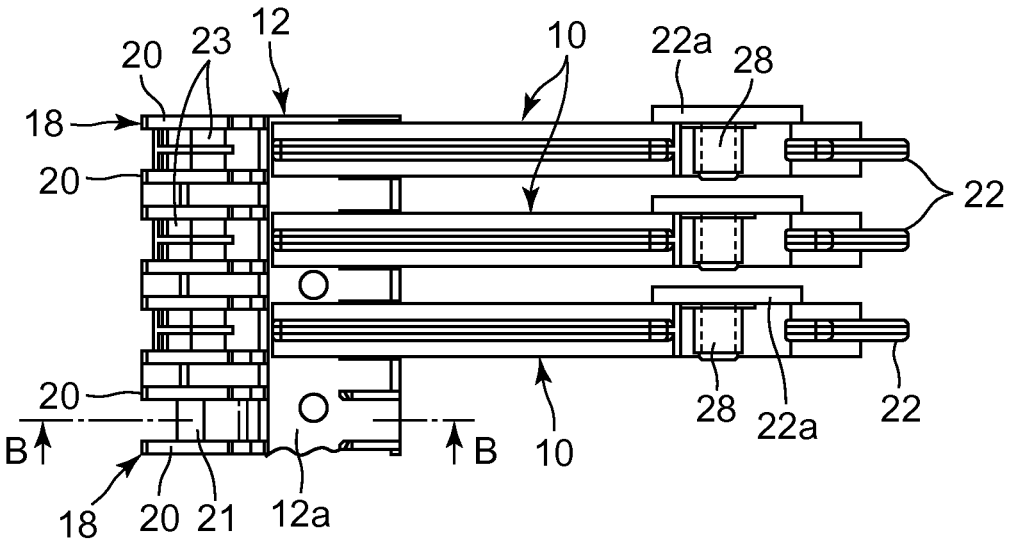
Figure 4B:
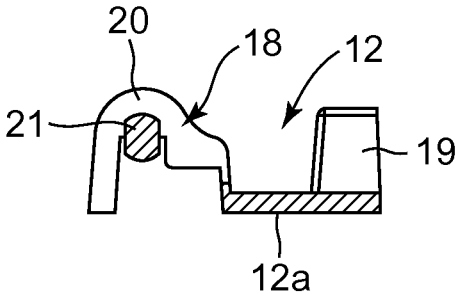

The transmission holding members 12 are made of hard synthetic resin such as ABS resin, and are integrally formed along the array direction of the keys 2 with a plurality of shaft support sections 18 on a body plate 12*a* respectively opposing, for example, ten keys 2, as depicted in FIG. 4A and FIG. 4B. The shaft support sections 18 are each structured to have the transmission member 10 rotatably mounted thereon so as to prevent the rolling of the transmission member 10.

That is, the shaft support section 18 has a pair of guide walls 20 and a transmission holding shaft 21 formed between the pair of guide walls 20, as depicted in FIG. 4A and FIG. 4B. The pair of guide walls 20 is formed corresponding to each of the plurality of transmission members 10 at a rear end portion (in FIG. 4A, a left end portion) on the body plate 12*a* of the transmission holding member 12.

This pair of guide walls 20 constitutes a guide section which rotatably guides the transmission fitting section 23 of the transmission member 10 with a later-described transmission fitting section 23 of the transmission member 10 being slidably interposed therebetween, as depicted in FIG. 4A. The transmission holding shaft 21 is formed in a substantially round-bar shape with the sides of its outer peripheral surface being cut off, and therefore has a non-circular shape in cross section, as depicted in FIG. 4A, FIG. 4B, and FIG. 5.

Also, the transmission holding member 12 has a regulating section 19 which regulates the rolling of the transmission member 10 when the keyboard device is packaged and transported, as depicted in FIG. 2 to FIG. 43. The regulating section 19 includes a pair of regulating walls formed corresponding to each transmission member 10 on a front portion (in FIG. 4A, aright side portion) of the body plate 12*a* of the transmission holding member 12. This regulating section 19 rotatably guides the transmission member 10 with a lower portion on the rear side of the transmission member 10 being interposed therebetween, and also regulates the rolling of the transmission member 10 when the keyboard device is packaged and transported.

The transmission members 10 are made of hard synthetic resin such as ABS resin, and has a transmission body section 22 that rotates in the vertical direction in response to a depression operation on a key 2 and thereby rotates the hammer member 11 in the vertical direction, and the transmission fitting section 23 integrally formed with the transmission body section 22 and rotatably mounted on the transmission holding shaft 21 of the transmission holding member 12, as depicted in FIG. 2 to FIG. 5.

Figure 5:
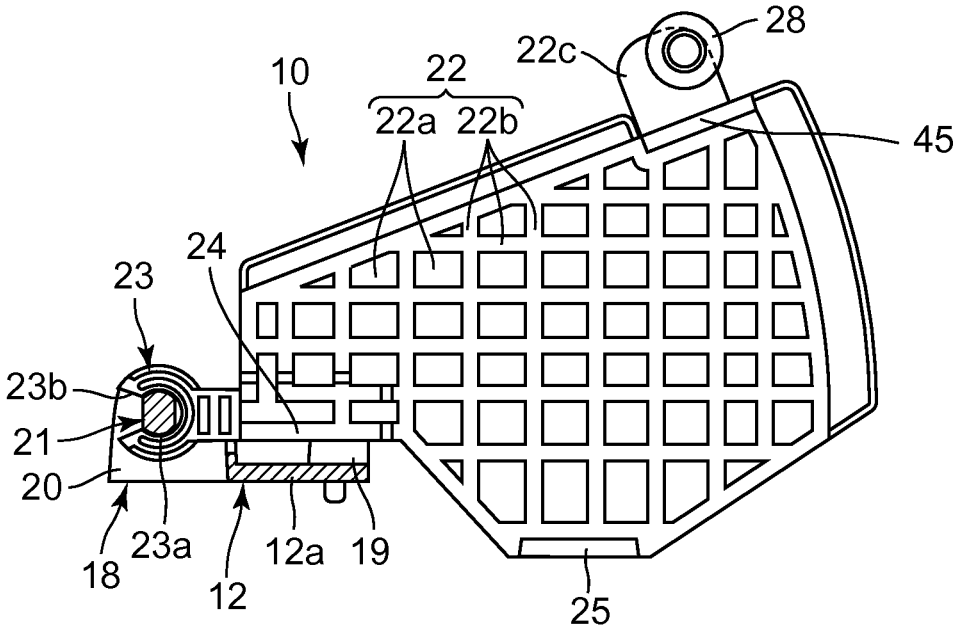
FIG. 5 is an enlarged view of the transmission member and the transmission holding member depicted in FIG. 3.

The transmission body section 22 is formed in a waffle shape, as depicted in FIG. 2, FIG. 3, and FIG. 5. That is, the transmission body section 22 has a thin vertical plate section 22*a* and a plurality of rib sections 22*b* formed in a lattice shape on an outer peripheral portion and both side surfaces of the vertical plate section 22*a*, which are formed in a waffle shape, as depicted in FIG. 5. Here, the transmission body section 22 is structured such that the weight of the transmission member 10 is adjusted by the shape of the vertical plate section 22*a* and the formation density of the plurality of rib sections 22*b*.

The transmission fitting section 23 is formed in an inverted C shape as a whole, and projects rearward at a rear end portion of the transmission body section 22, as depicted in FIG. 2, FIG. 3, and FIG. 5. That is, the transmission fitting section 23 is formed having a thickness in the array direction of the keys 2 substantially equal to a length between the paired guide walls 20 of the shaft support section 18, and slidably inserted between the paired guide walls 20, as depicted in FIG. 4A.

Also, the transmission fitting section 23 is structured to have a fitting hole 23*a* provided in the center thereof in which the transmission holding shaft 21 of the transmission holding member 12 fits, as depicted in FIG. 5. At a portion around fitting hole 23*a*, that is, at a rear portion around the fitting hole 23*a*, an insertion port 23*b* is formed into which the transmission holding shaft 21 is removably inserted. By the transmission holding shaft 21 being inserted into the fitting hole 23*a* through the insertion port 23*b*, the transmission fitting section 23 is rotatably mounted on the transmission holding shaft 21.

Here, the transmission fitting section 23 is structured such that, when the transmission holding shaft 21 is to be inserted into the fitting hole 23*a* through the insertion port 23*b*, the transmission fitting section 23 stands the transmission member 10 upright above the transmission holding shaft 21 so that the insertion port 23*b* corresponds to a portion of the transmission holding shaft 21 where both sides have been cut off, and then the insertion port 23*b* is slightly widened by the transmission holding shaft 21 when the transmission holding shaft 21 is pressed into the insertion port 23*b*, whereby the transmission holding shaft 21 is inserted and fitted into the fitting hole 23*a*, as depicted in FIG. 5.

At a lower portion on the rear side of the transmission body section 22 of the transmission member 10, a thin engaging section 24 that is regulated by the regulating section 19 of the transmission holding member 12 is provided, as depicted in FIG. 2 to FIG. 5. The side surfaces of this engaging section 24 at the lower portion on the rear side of the transmission body section 22 have been cut off, as depicted in FIG. 5.

Accordingly, the engaging section 24 has a thickness substantially equal to a length between the pair of regulating walls of the regulating section 19, as depicted in FIG. 5. As a result, the engaging section 24 is structured to rotatably guide the transmission member 10 by being inserted between the pair of regulating walls of the regulating section 19 and also regulate the rolling of the transmission member 10 when the keyboard device is packaged and transported.

Also, the transmission body section 22 of the transmission member 10 is formed such that its lower portion projects toward the upper surface of the key 2, as depicted in FIG. 2 to FIG. 5. At a lower end portion of the transmission body section 22, a transmission felt 25 is provided. The transmission felt 25 is structured to allow a capstan 26 provided on an upper portion on the rear side of the key 2 to come in contact with the transmission felt 25 from below.

As a result, the transmission member 10 is structured to be pressed up by the capstan 26 of the key 2 coming in contact with the transmission felt 25 from below when the key 2 is depressed, and thereby rotate around the transmission holding shaft 21 in the counterclockwise direction, as depicted in FIG. 2 and FIG. 3. Also, the transmission body section 22 of the transmission member 10 is formed such that its upper portion at the front end is higher than its upper portion at the rear end, so that its upper side portion is slanted downward to the rear portion (in FIG. 2, downward to the left).

On one side of the upper portion at the front end of the transmission body section 22, a support section 22*c* is provided projecting upward, as depicted in FIG. 2 to FIG. 5. That is, the support section 22*c* is structured to move in the vertical direction along a side surface of the hammer member 11 described below without coming in contact with the hammer member 11, Also, on a side surface of the support section 22*c*, an interlock projecting section 28 of an interlock control section 27 described below is provided.

On the other hand, as with the transmission support rail 14, the hammer support rail 15 is formed in a rectangular square tube shape in cross section and has a length corresponding to the entire length of the plurality of keys 2 in the array direction, as depicted in FIG. 1 to FIG. 3. This hammer support rail 15 is structured such that predetermined portions thereof in the array direction of the keys 2 are mounted on the front-side rail support sections 16*d* of the plurality of support members 16. On the hammer support rail 15, the plurality of hammer holding members 13 are mounted along the array direction of the keys 2.

Figure 6A:
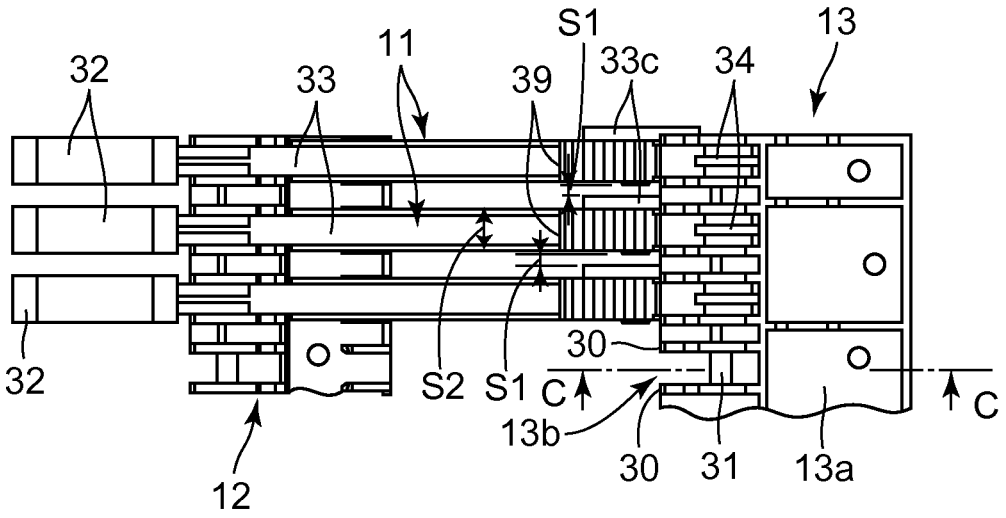
Figure 6B:
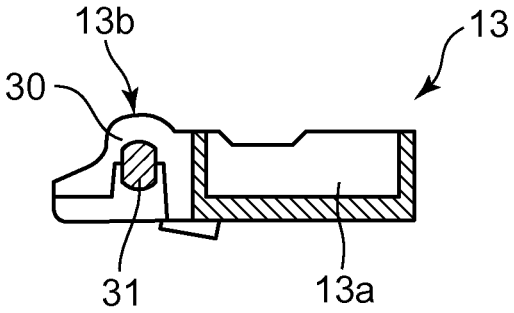
Figure 7:
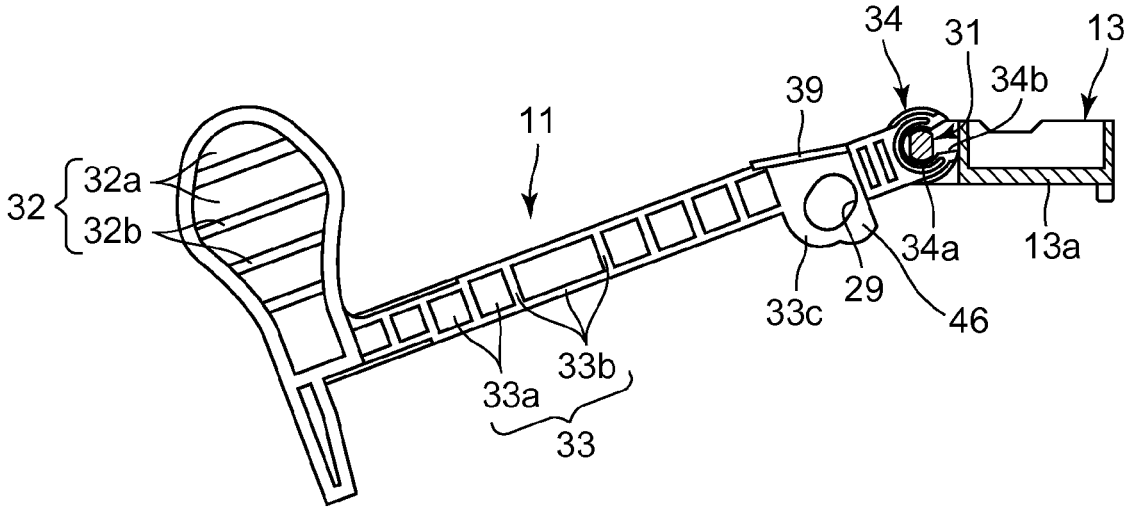
FIG. 7 is an enlarged view of the hammer member and the hammer holding member depicted in FIG. 3.

These hammer holding members 13 are made of hard synthetic resin such as ABS resin, and integrally formed along the array direction of the keys 2 with a shaft support section 13*b* being provided to a lower end portion of a rail-shaped body plate 13*a* whose upper portion is open and being opposed to each of, for example, ten keys 2, as depicted in FIG. 6A, FIG. 6B, and FIG. 7. The shaft support sections 13*b* are each structured to have the hammer member 11 rotatably mounted thereon so as to prevent the rolling of the hammer member 11.

That is, the shaft support section 13*b* has a pair of guide walls 30 and a hammer holding shaft 31 formed between the paired guide walls 30, as depicted in FIG. 2, FIG. 3, FIG. 6A, FIG. 6B, and FIG. 7. This pair of guide walls 30 is formed on a rear end portion (in FIG. 6B, a left end portion) of the body plate 13*a*, corresponding to each of the plurality of hammer members 11.

Also, this pair of guide walls 30 constitutes a guide section that rotatably guides the hammer fitting section 34 of the hammer member 11 with a hammer fitting section 34 of the hammer member 11 being interposed therebetween, as depicted in FIG. 6A and FIG. 6B. The hammer holding shaft 31 is formed in a substantially round-bar shape with both sides of its outer peripheral surface being cut off as with the transmission holding shaft 21, and therefore has a non-circular shape in cross section, as depicted in FIG. 6B.

The hammer member 11 is made of hard synthetic resin such as ABS resin, and has a hammer section 32 and a hammer arm 33, which are formed integrally, as depicted in FIG. 6A and FIG. 7. The hammer section 32 is structured to have a scoop-shaped vertical plate section 32*a* and a plurality of rib sections 32*b* formed on its outer peripheral portion and both side surfaces. Here, the hammer section 32 is structured such that the weight of the hammer member 11 is adjusted by the shape of the scoop-shaped vertical plate section 32*a* and the formation density of the plurality of rib sections 32*b*.

The hammer arm 33 is structured to have a lateral plate section 33*a* whose length in the front and rear direction is substantially equal to that of the transmission member 10 and rib sections 33*b* formed on its outer peripheral portion and both side surfaces, as depicted in FIG. 7. At a front end portion (in FIG. 7, a right end portion) of the hammer arm 33, the hammer fitting section 34 is formed, which is rotatably mounted on a hammer holding member 13.

As with the transmission fitting section 23, the hammer fitting section 34 is formed in an inverted C shape as a whole, and projects frontward at a front end portion of the hammer arm 33, as depicted in FIG. 7. The hammer fitting section 34 is formed such that its thickness in the array direction of the keys 2 is substantially equal to a length between the paired guide walls 30, and slidably inserted between the paired guide walls 30, as depicted in FIG. 6A.

Also, the hammer fitting section 34 is structured to have a fitting hole 34*a* provided in its center as depicted in FIG. 7, into which the hammer holding shaft 31 of the hammer holding member 13 is fitted. At a portion around the fitting hole 34*a*, that is, at a front portion around the fitting hole 34*a*, an insertion port 34*b* is formed into which the hammer holding shaft 31 is removably inserted. By the hammer holding shaft 31 being inserted into the fitting hole 34*a* through the insertion port 34*b*, the hammer fitting section 34 is rotatably mounted on the hammer holding shaft 31.

Here, the hammer fitting section 34 is structured such that, when the hammer holding shaft 31 is to be inserted into the fitting hole 34*a* through the insertion port 34*b*, the hammer fitting section 34 slants the hammer holding member 13 downward to the rear (in FIG. 7, to the right) so that the insertion port 34*b* corresponds to a portion of the hammer holding shaft 31 where both sides have been cut off, and then the insertion port 34*b* is slightly widened by the hammer holding shaft 31 when the hammer holding shaft 31 is pressed into the insertion port 34*b*, whereby the hammer holding shaft 31 is inserted and fitted into the fitting hole 34*a*, as depicted in FIG. 7.

That is, the hammer holding member 13 is structured such that, because it has been coupled to the transmission member 10 by the interlock control section 27 as depicted in FIG. 3 before the hammer member 11 is mounted, it is slanted downward to the rear so that the insertion port 34*b* of the hammer fitting section 34 corresponds to the hammer holding shaft 31 in FIG. 7, and then the hammer holding shaft 31 is mounted on the hammer support rail 15 after being inserted and fitted into the fitting hole 34*a*.

Figure 8A:
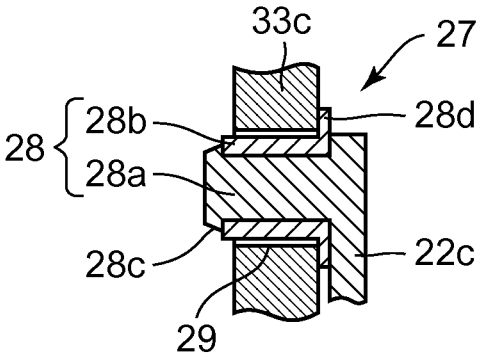

Also, at a lower portion at the front end of the hammer arm 33, a guide mount section 33*c* is provided projecting downward, as depicted in FIG. 3 and FIG. 8A. That is, the guide mount section 33*c* is structured such that its side surface opposes a side surface of the support section 22*c* of the transmission member 10 and its lower end portion opposes the upper surface of the transmission body section 22 of the transmission member 10. In this state, the guide mount section 33*c* moves in the vertical direction along the side surface of the support section 22*c*. Also, the guide mount section 33*c* is provided with a guide hole 29 for guiding an interlock projecting section 28 of the interlock control section 27 described later.

Also, the hammer arm 33 is structured such that a lower portion of its rear end comes in contact with a lower-limit stopper 35 from above and thereby is regulated at a lower-limit position that is an initial position, as depicted in FIG. 2 and FIG. 3. That is, the lower-limit stopper 35 is mounted on a lower-limit stopper rail 36 supported by a plurality of stopper support sections 17 provided on the transmission support rail 14. As a result, the hammer member 11 is structured to be positionally regulated at the initial position with it being slanted downward to the rear, by the lower portion at the rear end of the hammer arm 33 coming in contact with the lower-limit stopper 35 from above.

Figure 9:
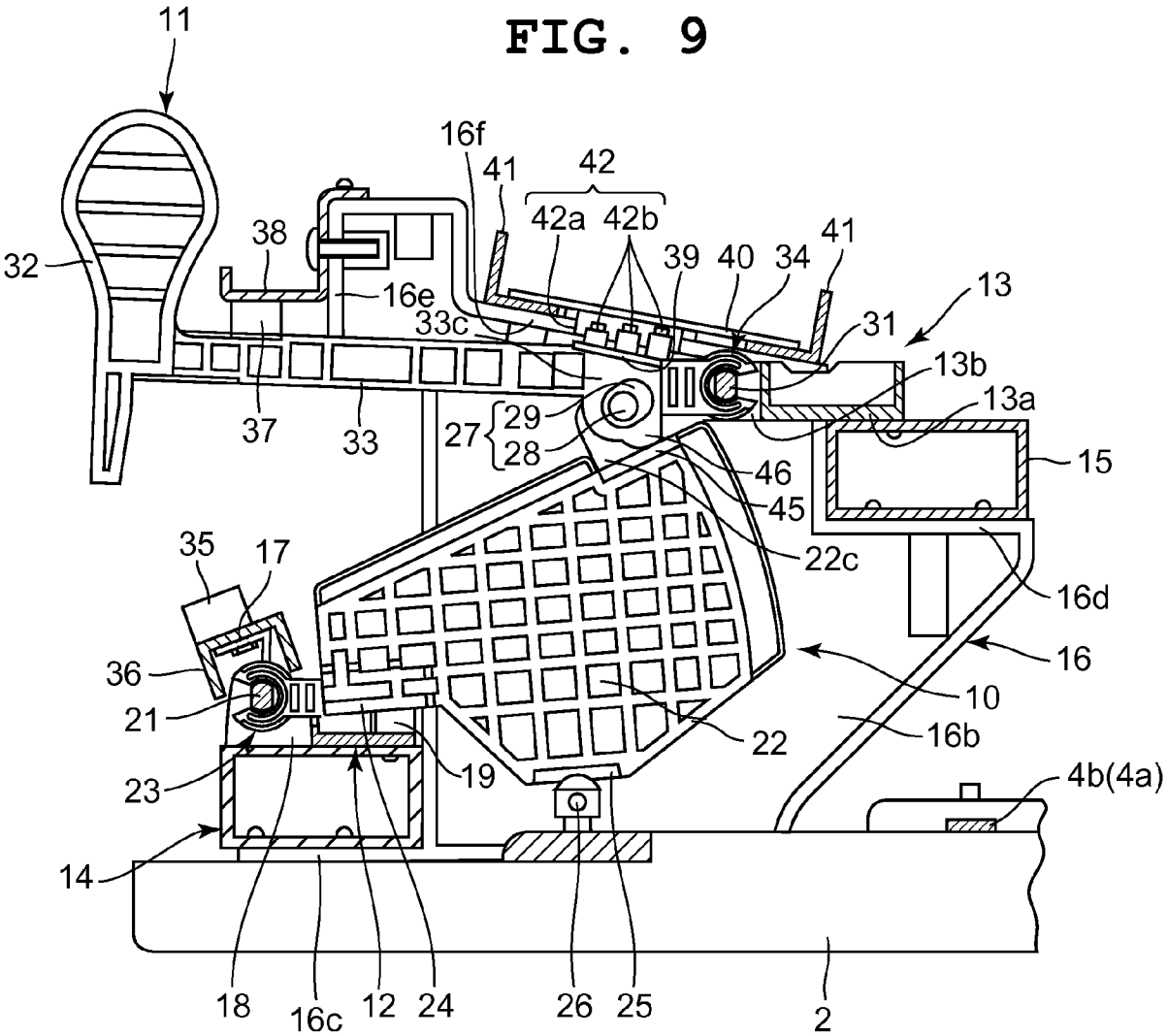
FIG. 9 is an enlarged sectional view of the main portion of the keyboard device depicted in FIG. 2, in which a key has been depressed.

Moreover, the hammer arm 33 is structured such that its upper portion at the rear end comes in contact with an upper-limit stopper 37 from below, and thereby is regulated at an upper-limit position, as depicted in FIG. 9. That is, this upper-limit stopper 37 is mounted on the lower surface of an upper-limit stopper rail 38 supported by each stopper rail support section 16*e* of the plurality of support members 16.

As a result, the hammer member 11 is structured such that, when the hammer arm 33 is rotated around the hammer holding shaft 31 of the hammer holding member 13 in the clockwise direction, the upper portion at the rear end of the hammer arm 33 comes in contact with the upper-limit stopper 37 from below, whereby the upper-limit position of the hammer member 11 is regulated, as depicted in FIG. 9.

Also, at an upper portion at the front end of the hammer arm 33, a switch pressing section 39 is formed, as depicted in FIG. 2 and FIG. 9. In an area above this switch pressing section 39 of the hammer arm 33, a switch substrate 40 is arranged by a pair of substrate support rails 41. These substrate support rails 41 are long plates each formed in an L shape in cross section, and have a length corresponding to the entire length of the keys 2 in the array direction.

These substrate support rails 41 are mounted such that their horizontal portions are away from each other by a predetermined space on the substrate support section 16*f* of each of the plurality of support members 16, as depicted in FIG. 1 to FIG. 3. The switch substrate 40 is divided into a plurality of portions, as depicted in FIG. 1. In the present embodiment, the switch substrate 40 is divided into four portions each having a length corresponding to twenty keys 2, and mounted on the pair of substrate support rails 41.

On the lower surface of each of the switch substrates 40, a rubber switch 42 is provided, as depicted in FIG. 2 and FIG. 9. The rubber switch 42 has an inverted-dome-shaped bulging section 42*a* formed on a rubber sheet elongated in the array direction of the keys 2 in a manner to correspond to each of the plurality of hammer arms 33. Inside the bulging section 42*a*, a plurality of movable contacts 42*b* that separably come in contact with a plurality of fixed contacts (not depicted) provided on the lower surface of the switch substrate 40 are provided along the front and rear direction of the hammer arm 33.

As a result, the rubber switch 42 is structured such that, when the hammer member 11 rotates around the hammer holding shaft 31 of the hammer holding member 13 in the clockwise direction and is pressed from below by the switch pressing section 39 of the hammer arm 33, the inverted-dome-shaped bulging section 42*a* is elastically deformed, and the plurality of movable contacts 42*b* sequentially come in contact with the plurality of fixed contacts at time intervals, whereby a switch signal according to the strength of the key depression operation on the key 2 is outputted. This switch signal is then supplied to a sound source section (not depicted), and a musical sound according to the key depression strength is generated, as depicted in FIG. 9.

The interlock control section 27 has the interlock projecting section 28 provided to the support section 22*c* of the transmission member 10 and the guide hole 29 provided to the guide mount section 33*c* of the hammer member 11 for guiding the interlock projecting section 28, as depicted in FIG. 2 and FIG. 3. As a result, the interlock control section 27 is structured to control the rotating motion of the hammer member 11 in accordance with the rotating motion of the transmission member 10 corresponding to the key 2 subjected to a key depression operation by a relative motion of the interlock projecting section 28 with respect to the guide hole 29.

Figure 8B:
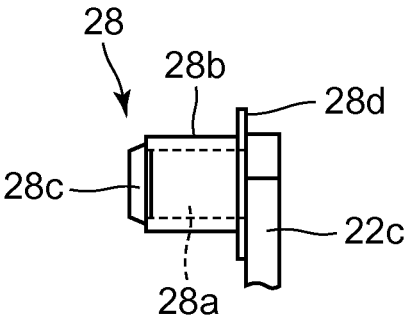
Figure 8C:
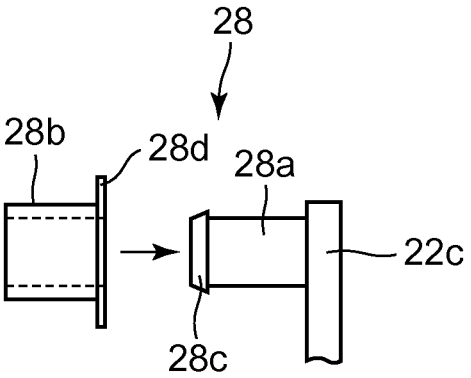

That is, the interlock projecting section 28 of the interlock control section 27 includes a rod-shaped projection body 28*a* and a cylindrical shock-absorbing section 28*b* provided on the outer periphery of the projection body 28*b*, as depicted in FIG. 5 and FIG. BA to FIG. 8C. The projection body 28*a* is formed in a round-bar shape, as depicted in FIG. 8A to FIG. BC.

This projection body 28*a* is integrally formed with an upper portion at the front end of the support section 22*c* provided to the transmission body section 22 of the transmission member 10 such that it projects toward the array direction of the keys 2 with it being away from the upper surface of the transmission body section 22 toward the hammer arm 33 by a predetermined space, and movably inserted into the guide hole 29 provided in the guide mount section 33*c* of the hammer member 11, as depicted in FIG. 3 and FIG. 5. Also, the projection body 28*a* has a hook portion 28*c* annularly formed on the outer perimeter of its tip.

The shock-absorbing section 28*b* is made of synthetic resin with elasticity such as urethane resin or silicone resin, and has a substantially cylindrical shape, as depicted in FIG. 8A to FIG. 8C. This shock-absorbing section 28*b* is formed such that its inner diameter is substantially equal to that of the projection body 28*a* and its length in the axial direction is equal to the length of the projection body 28*a* in the axial direction, that is, a length between the support member 22*c* and the hook section 28*c*.

At one end portion of the shock-absorbing section 28*b*, a sliding projection 28*d* which comes in contact with the support section 22*c* is formed in a flange shape, as depicted in FIG. 8A to FIG. 8C. As a result, the shock-absorbing section 28*b* is structured such that, when the shock-absorbing section 28*b* is mounted on the outer periphery of the projection body 28*a*, the flange-shaped sliding projection 28*d* comes in contact with the support member 22*c* and an end portion on the opposite side comes in contact with the hook section 28*c* of the projection body 28*a*, whereby the shock-absorbing section 28*b* is mounted on the projection body 28*a* with it being interposed between the support section 22*c* and the hook section 28*c*.

Here, a space S1 between the support section 22*c* of the transmission member 10 and the hook section 28*c* of the interlock projecting section 28 of its adjacent transmission member 10 is set to be half or shorter than the length (a width S2) of the hammer arm 33 in the arrange direction of the hammer members 11, as depicted in FIG. 6A. That is, two spaces S1, each of which is present between the support section 22*c* and the hook section 28*c* of the interlock projecting section 28, are present between hammer arms 33 adjacent to each other, and these two spaces S1 are set smaller than the width S2 of the hammer arm 33.

As a result, the hammer member 11 is structured such that, when the hammer fitting section 34 of the hammer arm 33 is rotatably mounted on the hammer holding shaft 31 of the hammer holding member 13, since the space S1 between the support section 22*c* and the hook section 28*c* of the interlock projecting section 28 is half or shorter than the width S2 of the hammer arm 33, the hammer member 11 is prevented by the adjacent hammer members 11 from falling off the hammer holding member 13, as depicted in FIG. 6A and FIG. 6B.

On the other hand, the guide hole 29 of the interlock control section 27 is a long hole into which the interlock projecting section 28 is movably inserted, and provided in the guide mount section 33*c* provided on a lower portion at the front end of the hammer arm 33 of the hammer member 11, as depicted in FIG. 3, FIG. 8A, and FIG. 9. The guide hole 29 is a long hole elongated along a relative motion path (that is, moving path) of the interlock projecting section 28 when the transmission member 10 performs a rotating motion around the transmission holding shaft 21 and the hammer member 11 performs a rotating motion around the hammer holding shaft 31.

That is, the guide hole 29 is provided such that its center line in the longitudinal direction is slanted downward to the rear (in FIG. 3, downward to the left), as depicted in FIG. 3, FIG. 8A, and FIG. 9. Also, the guide hole 29 is formed such that its length (hole width) in a direction orthogonal to the longitudinal direction is substantially equal to the outer diameter of the interlock projecting section 28, that is, the outer diameter of the shock-absorbing section 28*b*, and its length in the longitudinal direction is substantially one and a half or two times as long as the outer diameter of the interlock projecting section 28.

Here, the guide hole 29 is structured such that, when it moves with the interlock projecting section 28 being inserted thereinto, the shock-absorbing section 28*b* of the interlock projecting section 28 moves while elastically coming in contact with the inner peripheral surface of the guide hole 29, and a sliding projection 29*d* of the shock-absorbing section 28*b* slides while elastically coming in contact with a side edge portion of the guide hole 29, that is, the side surface of the guide mount section 33*c* of the hammer section 11, whereby the guide mount section 33*c* of the hammer member 11 is prevented from directly coming in contact with the support section 22*c* of the transmission member 10, as depicted in FIG. 3, FIG. 8A, and FIG. 9.

Thus, the interlock control section 27 is structured such that, when the transmission member 10 corresponding to a key 2 subjected to a key depression operation makes a rotating motion and the hammer member 11 makes a rotating motion along with this rotating motion of the transmission member 10, the rotating motion of the hammer member 11 is controlled by a relative motion of the interlock projecting section 28 with respect to the guide hole 29, as depicted in FIG. 3 and FIG. 9.

That is, the interlock control section 27 is structured such that, when the key 2 is subjected to a key depression operation and the transmission member 10 rotates around the transmission holding shaft 21 in the counterclockwise direction, the interlock projecting section 28 moves upward with the guide hole 29 while being positioned near or coming in contact with the upper portion at the front end of the guide hole 29 in response to the rotation of the transmission member 10, whereby the hammer member 11 rotates around the hammer holding shaft 31 in the clockwise direction, as depicted in FIG. 3.

Also, this interlock control section 27 is structured such that, when the hammer member 11 is pressed upward, the interlock projecting section 28 becomes movable along the guide hole 29, whereby the transmission member 10 and the hammer member 11 can make a rotating motion in conjunction with each other regardless of whether or not the rotation speed of the transmission member 10 and the rotation speed of the hammer member 11 are the same, as depicted in FIG. 9.

Moreover, this interlock control section 27 is structured such that, when the key 2 subjected to a key depression operation is to return to the initial position, since the interlock projecting section 28 is in a state of being relatively movable with respect to the guide hole 29, the transmission member 10 rotates around the transmission holding shaft 21 in the clockwise direction by its self weight, and the hammer member 11 rotates around the hammer holding shaft 31 in the counterclockwise direction by its self weight, as depicted in FIG. 9.

Furthermore, the interlock control section 27 is structured such that, when the transmission member 10 and the hammer member 11 return to their initial positions, the interlock projecting section 28 moves toward the upper portion at the front end of the guide hole 29, whereby the interlock projecting section 28 comes in contact with or approaches the upper portion at the front end of the guide hole 29, as depicted in FIG. 3.

On the upper surface of the transmission body section 22 of each of the transmission members 10, a shock-absorbing member 45 is provided, as depicted in FIG. 3, FIG. 5, and FIG. 9. The shock-absorbing member 45 is a sheet with elasticity such as felt, and provided on the upper surface of the transmission body section 22 positioned on the lower side of the interlock projecting section 28. On the other hand, each of the hammer members 11 is provided with an abutting section 46 that elastically comes in contact with the shock-absorbing member 45, as depicted in FIG. 3, FIG. 7, and FIG. 9. This abutting section 46 is provided to the guide mount section 33*c* on a lower portion of the hammer arm 33.

That is, this abutting section 46 is provided to a lower end portion of the guide mount section 33*c* corresponding to the shock-absorbing member 45 and projects in an arc shape, as depicted in FIG. 3, FIG. 7, and FIG. 9. As a result, the abutting section 46 is structured to slide while elastically coming in contact with the shock-absorbing member 45 when the transmission member 10 is pressed up by the key 2 being depressed and the hammer member 11 is pressed up by this transmission member 10.

Also, the abutting section 46 is structured such that, when the switch pressing section 39 of the hammer arm 33 presses the rubber switch 42 of the switch substrate 40 and the hammer member 11 comes in contact with the upper-limit stopper 37, the abutting section 46 slides while coming in pressure contact with and elastically engaging with the shock-absorbing member 45, but the engaging force and the friction force of the abutting section 46 with respect to the shock-absorbing member 45 are reduced by the elasticity of the shock-absorbing section 28*b* of the interlock projecting section 28, as depicted in FIG. 9.

Next, the operation of the above-described keyboard device 1 of the electronic keyboard instrument is described.

Here, the keys 2 of the keyboard device 1 are subjected to key depression operations for musical performance. When one of the keys 2 is depressed, this key 2 rotates around the balance pins 4*a* and 4*b* in the clockwise direction in FIG. 3, and the capstan 26 of the key 2 presses up the transmission member 10. As a result, the transmission member 10 rotates around the transmission holding shaft 21 of the transmission holding member 12 in the counterclockwise direction in FIG. 3.

Then, the shock-absorbing member 45 of the transmission member 10 presses up the abutting section 46 of the guide mount section 33*c* of the hammer member 11. As a result, the rotating motion of the transmission member 10 is transmitted to the hammer member 11, whereby the hammer member 11 is pressed up. Here, the interlock projecting section 28 of the support section 22*c* moves upward with the guide hole 29 while being positioned near or coming in contact with the upper portion at the front end of the guide hole 29 of the guide mount section 33*c* in response to the rotation of the transmission member 10. As a result, the hammer member 11 rotates around the hammer holding shaft 31 of the hammer holding member 13 in the clockwise direction in FIG. 3, and thereby provides an action load to the key 2.

That is, when the hammer member 11 rotates around the hammer holding shaft 31 in the clockwise direction in FIG. 3, an action load is provided to the key 2 by the moment of inertia of the hammer member 11. Here, the hammer arm 33 has been formed such that its length in the front and rear direction of the key 2 is substantially equal to the length of the transmission member 10 and has the hammer section 32 formed at the rear end portion of the hammer arm 33.

In addition, the hammer fitting section 34 of the hammer arm 33 has been rotatably mounted on the hammer holding shaft 31 in this state. Accordingly, when the hammer member 11 rotates around the hammer holding shaft 31 in the clockwise direction, a moment of inertia occurs in the hammer member 11. A load by this moment of inertia is provided as an action load to the key 2 via the guide mount section 33*c* of the hammer member 11 and the transmission member 10. As a result, a key-touch feel close to that of an acoustic piano can be acquired.

When the hammer member 11 rotates around the hammer holding shaft 31 in the clockwise direction as described above, the switch pressing section 39 of the hammer arm 33 presses the inverted-dome-shaped bulging section 42*a* of the rubber switch 42 provided to the switch substrate 40 from below, as depicted in FIG. 9. Here, the inverted-dome-shaped bulging section 42*a* is elastically deformed and the plurality of movable contacts 42*b* in the bulging section 42*a* sequentially come into contact with the plurality of fixed contacts at time intervals. As a result, a switch signal in accordance with the depressed key 2 is outputted, and a musical sound is emitted from a loudspeaker (not depicted).

Then, when the hammer member 11 further rotates around the hammer holding shaft 31 in the clockwise direction, the upper portion at the lower end of the hammer arm 33 comes in contact with the upper-limit stopper 37 from below to regulate and stop the rotation of the hammer member 11. Here, the arc-shaped abutting section 46 of the guide mount section 33*c* of the hammer member 11 slides while coming in pressure contact with and elastically engaging with the shock-absorbing member 45 of the transmission member 10, and the interlock projecting section 28 comes in pressure contact with the upper portion at the front end of the guide hole 29.

Here, the shock-absorbing section 28*b* of the interlock projecting section 28 elastically comes in pressure contact with the upper portion at the front end of the guide hole 29. Accordingly, by the elasticity of the shock-absorbing section 28*b* of the interlock projecting section 28, the engaging force and the friction force of the abutting section 46 with respect to the shock-absorbing member 45 are reduced. As a result, the occurrence of unusual noise due to engagement and friction between the abutting section 46 and the shock-absorbing member 45 is inhibited.

Then, when a key release motion (returning motion) for returning the key 2 to its initial position is started, the transmission member 10 rotates in the clockwise direction by its self weight to return to its initial position with the interlock projecting section 28 being relatively movable with respect to the guide hole 29, and the hammer member 11 rotates in the counterclockwise direction by its self weight to return to its initial position. As a result, the key 2 returns to its initial position, and the interlock projecting section 28 of the interlock control section 27 comes in contact with or approaches the upper portion at the front end of the guide hole 29.

In the above-described keyboard device 1, when a key 2 is subjected to a key depression operation by a light force (weak force), this key 2 slowly rotates around the balance pins 4*a* and 4*b* in the clockwise direction and the capstan 26 of the key 2 slowly presses up the transmission member 10. As a result, the transmission member 10 slowly rotates around the transmission holding shaft 21 of the transmission holding member 12 in the counterclockwise direction. Here, the shock-absorbing member 45 of the transmission member 10 slowly presses up the abutting section 46 of the guide mount section 33*c* of the hammer member 11. Here, the interlock projecting section 28 of the interlock control section 27 slowly moves upward while being positioned near or coming in contact with the upper portion at the front end of the guide hole 29.

As a result, the hammer member 11 slowly rotates around the hammer holding shaft 31 of the hammer holding member 13 in the clockwise direction and provides an action load to the key 2. Then, the switch pressing section 39 of the hammer member 11 presses the rubber switch 42 provided to the switch substrate 40 and causes it to make a switching motion, whereby the upper portion at the rear end of the hammer member 11 comes in contact with the upper-limit stopper 37 from below and stops the rotation of the hammer member 11. Here, the arc-shaped abutting section 46 of the guide mount section 33*c* of the hammer member 11 slowly slides while coming in pressure contact with and elastically engaging with the shock-absorbing member 45 of the transmission member 10, and the interlock projecting section 28 slowly comes in pressure contact with the upper portion at the front end of the guide hole 29.

In this state, when a key release motion (returning motion) for returning the key 2 to its initial position is started, the transmission member 10 rotates in the clockwise direction by its self weight and the counterforce by the pressure contact of the abutting section 46 with respect to the shock-absorbing member 45, and returns to the initial position, with the interlock projecting section 28 of the interlock control section 27 being in contact with or positioned near the upper portion at the front end of the guide hole 29. In addition, the hammer member 11 rotates in the counterclockwise direction by its self weight and the counterforce by the pressure contact of the abutting section 46 with respect to the shock-absorbing member 45 and returns to the initial position. As a result, the key 2 returns to the initial position.

In the above-described keyboard device 1, when a key 2 is subjected to a key depression operation by a strong force, this key 2 quickly rotates around the balance pins 4*a* and 4*b* in the clockwise direction and the capstan 26 of the key 2 presses up the transmission member 10 at high speed. As a result, the transmission member 10 quickly rotates around the transmission holding shaft 21 of the transmission holding member 12 in the counterclockwise direction. Here, the shock-absorbing member 45 of the transmission member 10 abruptly presses up the abutting section 46 of the guide mount section 33*c* of the hammer member 11 at high speed.

As a result, the hammer member 11 abruptly and quickly rotates around the hammer holding shaft 31 of the hammer holding member 13 in the clockwise direction and provides an action load to the key 2. Here, when the rotation speed of the hammer member 11 is higher than the rotation speed of the transmission member 10, the abutting section 46 of the guide mount section 33*c* of the hammer member 11 moves upward and away from the shock-absorbing member 45 of the transmission member 10. Accordingly, the upper portion at the front end of the guide hole 29 of the interlock control section 27 moves away from the interlock projecting section 28, and the interlock projecting section 28 relatively moves inside the guide hole 29 toward its lower portion at the rear end.

Then, the switch pressing section 39 of the hammer member 11 abruptly presses the rubber switch 42 provided to the switch substrate 40 so that it makes a switching motion, and the upper portion at the rear end of the hammer member 11 abruptly comes in contact with the upper-limit stopper 37 from below. Accordingly, the upper portion at the rear end of the hammer member 11 bounces off the upper-limit stopper 37.

Here, because the bounced hammer member 11 rotates around the hammer holding shaft 31 in the counterclockwise direction as depicted in FIG. 9, the abutting section 46 of the guide mount section 33*c* of the hammer member 11 again comes in contact with the shock-absorbing member 45 of the transmission member 10 elastically, and the interlock projecting section 28 of the interlock control section 27 again approaches the upper portion at the front end of the guide hole 29.

In this state, the transmission member 10 continuously rotates around the transmission holding shaft 21 of the transmission holding member 12 in the counterclockwise direction. Therefore, the abutting section 46 of the guide mount section 33*c* of the hammer member 11 comes in pressure contact with the shock-absorbing member 45 of the transmission member 10, and the interlock projecting section 28 of the interlock control section 27 comes in pressure contact with the upper portion at the front end of the guide hole 29, whereby the bounce of the hammer member 11 is inhibited.

Then, when a key release motion (returning motion) for returning the key 2 to its initial position is started, the interlock projecting section 28 of the interlock control section 27 approaches or comes in contact with the upper portion at the front end of the guide hole 29 with it being movable along the guide hole 29. In this state, the transmission member 10 rotates in the clockwise direction by its self weight and the counterforce by the pressure contact of the abutting section 46 with respect to the shock-absorbing member 45, and thereby returns to the initial position. In addition, the hammer member 11 rotates in the counterclockwise direction by its self weight and the counterforce by the pressure contact of the abutting section 46 with respect to the shock-absorbing member 45, and thereby returns to the initial position. As a result, the key 2 returns to the initial position.

Also, In a so-called sequential depression operation of sequentially depressing one key 2 of the keyboard device 1, this key 2 is subjected to a key depression operation once, and then subjected to a key depression operation again while the hammer member 11, the transmission member 10, and the key 2 are returning to their initial positions after the hammer member 11 is pressed up and reaches the upper-limit position. Here, the interlock projecting section 28 of the interlock control section 27 can move along the guide hole 29, with the abutting section 46 of the guide mount section 33*c* of the hammer member 11 being positioned near or in contact with the shock-absorbing member 45 of the transmission member 10.

Therefore, the hammer member 11 and the transmission member 10 make returning motions toward their initial positions by their own weights regardless of whether or not the rotation speed of the hammer member 11 in the returning direction and the rotation speed of the transmission member 10 in the returning direction are the same, and the key 2 also performs a returning motion along with it toward the initial position. Subsequently, when the key 2 is again subjected to a key depression operation in the course of its returning motion, the transmission member 10 in the course of returning to the initial position is again pressed up by the capstan 26 of the key 2.

Then, the transmission member 10 in the course of returning to the initial position rotates again around the transmission holding shaft 21 in the counterclockwise direction. Here, because the shock-absorbing member 45 of the transmission member 10 again presses up the abutting section 46 of the guide mount section 33*c* of the hammer member 11, the interlock projecting section 28 of the interlock control section 27 moves along the guide hole 29, and is positioned near or comes in contact with the upper portion at the front end of the guide hole 29. As a result, the hammer member 11 in the course of returning to the initial position rotates again around the hammer holding shaft 31 in the clockwise direction, provides an action load to the key 2, and presses the rubber switch 42 so that it makes a switching motion.

That is for a sequential depression operation on one key 2, the retuning motion of the hammer member 11 and the returning motion of the transmission member 10 are controlled by a relative movement of the interlock projecting section 28 with respect to the guide hole 29 of the interlock control section 27. As a result, the sequential depression operation of sequentially depressing one key 2 can be favorably performed, whereby the sequential depression performance is improved.

As described above, the keyboard device 1 of the electronic keyboard instrument includes the plurality of transmission members 10 provided corresponding to the plurality of keys 2 arranged in parallel and perform rotating motions in accordance with key depression operations on the plurality of keys 2, the plurality of hammer members 11 provided corresponding to the plurality of keys 2 and perform rotating motions in accordance with the rotating motions of the transmission members 10 so as to provide action loads to the keys 2, and the plurality of interlock control sections 27 each of which controls the rotating motion of the hammer member 11 in accordance with the rotating motion of the transmission member 10 by a relative motion of the interlock projecting section 28 of the transmission member 10 with respect to the guide hole 29 provided in the hammer member 11. Therefore, a downsized simple structure can be achieved, an unnecessary motion of the hammer member 11 can be inhibited, and a key-touch feel close to that of an acoustic piano can be acquired.

That is, in the keyboard device 1 of the electronic keyboard instrument, when a key 2 is subjected to a key depression operation and the transmission member 10 makes a rotating motion, the interlock control section 27 is operated in accordance with the rotating motion of the transmission member 10, and the hammer member 11 makes a rotating motion, whereby an action load can be provided to the key 2. Also, by the interlock projecting section 28 of the interlock control section 27 making a motion of relatively moving along the guide hole 29, an unnatural and unnecessary motion of the hammer member 11 can be controlled.

For example, when a key 2 is pressed by a weak force, the interlock control section 27 causes the transmission member 10 to slowly press up the hammer member 11 for rotation, with the interlock projecting section 28 of the transmission member 10 being positioned near or coming in contact with the upper portion at the front end of the guide hole 29 of the hammer member 11. Also, the interlock control section 27 causes the transmission member 10 and the hammer member 11 to return to their initial positions by their self weights when the key 2 returns to the initial position, with the interlock projecting section 28 being positioned near or coming in contact with the upper portion at the front end of the guide hole 29.

Also, when a key 2 is pressed by a strong force, the interlock control section 27 causes the transmission member 10 to strongly press up the hammer member 11 for rotation, with the interlock projecting section 28 of the transmission member 10 being positioned near or coming in contact with the upper portion at the front end of the guide hole 29 of the hammer member 11. Here, when the hammer member 11 presses the rubber switch 42 and bounces off the upper-limit stopper 37 after strongly coming in contact therewith, the interlock projecting section 28 is relatively moved along the guide hole 29 toward the lower portion at the rear end of the guide hole 29, and is positioned near or comes in contact with the lower portion at the rear end of the guide hole 29.

Accordingly, although the hammer member 11 rotates toward the initial position earlier than the transmission member 10, the interlock control section 27 can control the rotating motion of the hammer member 11 by a relative motion of the interlock projecting section 28 with respect to the guide hole 29. That is, since the interlock projecting section 28 can be relatively moved along the guide hole 29, an unnatural and unnecessary motion of the hammer member 11 due to the bounceback of the hammer member 11 by hard key depression can be favorably inhibited, whereby the keyboard performance is improved.

Also, in a sequential depression operation of sequentially depressing one key 2, the interlock control section 27 can control a returning motion of the hammer member 11 and a returning motion of the transmission member 10 by a relative movement of the interlock projecting section 28 with respect to the guide hole 29 of the interlock control section 27. Accordingly, the sequential depression operation of sequentially depressing one key 2 can be reliably and favorably performed, whereby the sequential depression performance can be improved.

As described above, in the keyboard device 1, the interlock control section 27 is structured to include the interlock projecting section 28 provided to the transmission member 10 and the guide hole 29 provided in the hammer member 11 for guiding the interlock projecting section 28. Therefore, the structure of the interlock control section 27 is simple, so that the interlock control sections 27 can be installed compactly. Therefore, the installation space of the interlock control section 27 can be minimized, whereby the size of the entire device can be reduced. In addition, since an unnatural and unnecessary motion of the hammer member 11 can be inhibited by the interlock control section 27, a key-touch feel close to that of an acoustic piano can be acquired.

Here, the guide hole 29 of the interlock control section 27 is a long hole formed at a portion in accordance with the displacement of a relative distance between the hammer holding shaft 31 which is the rotation center of the hammer member 11 and the interlock projecting section 28. Therefore, when the rotation speed of the transmission member 10 and the rotation speed of the hammer member 11 are different from each other, the interlock projecting section 28 can be relatively moved along the guide hole 29 smoothly and favorably, whereby the motion of the hammer member 11 when the key is depressed can be favorably controlled, and an unnatural and unnecessary motion of the hammer member 11 can be inhibited.

Accordingly, even when the hammer member 11 strongly comes in contact with the upper-limit stopper 37 and bounces off this upper-limit stopper 37, the interlock projecting section 28 can be relatively moved along the guide hole 29.

Therefore, an unnatural and unnecessary motion of the hammer member 11 can be favorably inhibited. Also, the interlock projecting section 28 can be relatively moved along the guide hole 29 even when the hammer member 11 rotates toward the initial position earlier than the transmission member 10. Therefore, the motion of the hammer member 11 when the key is depressed can be favorably controlled.

Also, the interlock projecting section 28 of the interlock control section 27 includes the rod-shaped projection body 28*a* and the shock-absorbing section 28*b* provided on the outer periphery of the projection body 28*a*. Therefore, when the interlock projecting section 28 relatively moves inside the guide hole 29, the shock-absorbing section 28*b* is moved with it elastically coming in contact with the inner peripheral surface of the guide hole 29. In addition, the shock-absorbing section 28*b* elastically comes in contact with one of the ends inside the guide hole 29 when the interlock projecting section 28 comes in contact with one of the ends inside the guide hole 29. Accordingly, the occurrence of unusual noise can be reliably and favorably prevented.

In this embodiment, the shock-absorbing section 28*b* includes the sliding projection 28*d* which elastically slides along the guide edge portion of the guide hole 29. Accordingly, the sliding projection 28*d* can be arranged between the support section 22*c* of the transmission member 10 where the interlock projecting section 28 is provided and the guide mount section 33*c* of the hammer member 11 where the guide hole 29 is provided. Therefore, the support section 22*c* of the transmission member 10 and the guide mount section 33*c* of the hammer member 11 do not directly come in contact with each other, which also reliably and favorably prevent the occurrence of unusual noise when the interlock projecting section 28 relatively moves inside the guide hole 29.

Moreover, the interlock projecting section 28 has the hook section 28*c* provided on the outer perimeter of the tip of the projection body 28*a*. Therefore, the interlock projecting section 28 can be reliably and favorably mounted on the outer perimeter of the projection body 28*a* with the shock-absorbing section 28*b* being interposed between the hook section 28*c* and the support section 22*c* of the transmission member 10. Accordingly, the shock-absorbing section 28*b* can be prevented from falling off the projection body 28*a* when the interlock projecting section 28 relatively moves inside the guide hole 29.

Also, the keyboard device 1 includes the plurality of shock-absorbing members 45 respectively provided to the plurality of transmission members 10, and the plurality of abutting sections 46 respectively provided to the plurality of hammer members 11 and elastically come in contact with the plurality of shock-absorbing members 45. Therefore, when the transmission member 10 rotates around the transmission holding shaft 21 by a key depression operation on the key 2, the rotating motion of the transmission member 10 can be reliably and favorably transmitted to the hammer member 11 by the shock-absorbing member 45 of the transmission member 10 and the abutting section 46 of the hammer member 11.

In this embodiment, the transmission body section 22 of the transmission member 10 is provided with the support section 22*c* where the interlock projecting section 28 is mounted projecting in the array direction of the keys 2. In addition, on the hammer arm 33 of the hammer member 11, the guide mount section 33*c* having the guide hole 29 is provided opposing the support section 22*c* of the transmission member 10. Accordingly, an increase in the number of the components is prevented, whereby the interlock control section 27 can be provided compactly, and the shock-absorbing member 45 and the abutting section 46 can be compactly provided to the interlock control section 27.

That is, in the keyboard device 1, the support section 22*c* of the transmission member 10 is provided projecting from the side portion of the transmission body section 22 of the transmission member 10 toward the hammer member 11, the shock-absorbing member 45 is provided on the upper surface of the transmission body section 22 corresponding to the interlock projecting section 28 mounted to the support section 22*c*, the guide mount section 33*c* of the hammer member 11 is provided to the hammer arm 33 while projecting toward the shock-absorbing member 45 of the transmission member 10, and the abutting section 46 is provided to the guide mount section 33*c* with it elastically coming in contact with the shock-absorbing member 45. Accordingly, the shock-absorbing member 45 and the abutting section 46 can be compactly provided to the interlock control section 27, and braking performance by the interlock control section 27 can be improved.

Here, the abutting section 46 is provided projecting in an arc shape at the lower end portion of the guide mount section 33*c* of the hammer arm 33 corresponding to the shock-absorbing member 45. Accordingly, when the hammer member 11 rotates around the hammer holding shaft 31 with the abutting section 46 elastically coming in contact with the shock-absorbing member 45, the abutting section 46 projecting in an arc shape smoothly slides along the shock-absorbing member 45. Also, this abutting section 46 projecting in an arc shape slides smoothly even when it is elastically engaging with the shock-absorbing member 45. As a result, the occurrence of unusual noise can be prevented.

In the above-described embodiment, the interlock projecting section 28 of the interlock control section 27 is provided to the transmission member 10 and the guide hole 29 is provided in the hammer member 11. However, the present invention is not limited to this. For example, a structure may be adopted in which the interlock projecting section 28 is provided to the guide mount section 33*c* of the hammer member 11 and the guide hole 29 is provided in the support section 22*c* of the transmission member 10.

In this structure, when the key 2 is depressed by a weak force, the transmission member 10 can slowly press up and rotate the hammer member 11 for rotation with the interlock projecting section 28 of the hammer member 11 being positioned near or coming in contact with the lower portion at the rear end of the guide hole 29 of the transmission member 10. Also, when the key 2 is to return to the initial position, the transmission member 10 and the hammer member 11 can be each returned to the initial position by its self weight with the interlock projecting section 28 being positioned near or coming in contact with the lower portion at the rear end of the guide hole 29.

Also, when the key 2 is depressed by a strong force, the transmission member 10 strongly presses up the hammer member 11 with the interlock projecting section 28 of the hammer member 11 being positioned near or coming in contact with the lower portion at the rear end of the guide hole 29 of the transmission member 10, whereby the hammer member 11 can be rotated strongly. Here, even though the hammer member 11 strongly comes in contact with and bounces off the upper-limit stopper 37, the interlock projecting section 28 can be moved along the guide hole 29.

With this interlock control section 27 as well, the interlock projecting section 28 of the hammer member 11 can be moved toward the lower portion at the rear end of the guide hole 29 of the transmission member 10 when the hammer member 11 rotates toward the initial position earlier than the transmission member 10. Therefore, the rotating motion of the hammer member 11 can be controlled by a relative motion of the interlock projecting section 28 with respect to the guide hole 29. Thus, an unnatural and unnecessary motion of the hammer member 11 can be inhibited, and therefore a key-touch feel close to that of an acoustic piano can be acquired, as with the above-described embodiment.

In addition, even in a sequential key depression operation of sequentially depressing one key 2, the returning motion of the hammer member 11 and the returning motion of the transmission member 10 can be controlled by a relative motion of the interlock projecting section 28 with respect to the guide hole 29 of the interlock control section 27. As a result, the sequential key depression operation of sequentially depressing one key 2 can be reliably and favorably performed, whereby the sequential key depression performance can be improved.

Also, in the above-described embodiment, the shock-absorbing member 45 is provided to the transmission member 10 and the abutting section 46 is provided to the guide mount section 33*c* of the hammer member 11. However, the present invention is not limited thereto. For example, a structure may be adopted in which a support section where the interlock projecting section 28 is provided to the hammer arm 33 of the hammer member 11 is mounted, a shock-absorbing member is provided to the hammer member 11 in a manner to correspond to the interlock projecting section 28, amount section having the guide hole 29 into which the interlock projecting section 28 is movably inserted is provided to the transmission body section 22 of the transmission member 10, and an abutting section is provided to the mount section.

Moreover, in the above-described embodiment, a guide section for guiding the interlock projecting section 28 of the interlock control section 27 is the guide hole 29. However, the guide section is not necessarily the guide hole 29, and may be a guide groove section having a guide wall. In this case as well, the guide groove section is only required to be formed by being elongated along a relative motion path of the interlock projecting section 28.

Furthermore, in the above-described embodiment and the modification examples, the interlock projecting section 28 of the interlock control section 27 is provided to the support section 22*c* of the transmission member 10 or the guide mount section 33*c* of the hammer member 11 in a cantilever shape. However, the present invention is not limited thereto. For example, the interlock projecting section 28 may be provided in a both-end-support beam shape.

Still further, in the above-described embodiment, the transmission member is structured to perform a rotating motion. However, the present invention is not limited thereto. For example, a structure may be adopted in which a key depressing force is transmitted to the hammer member 11 by the vertical displacement (movement) of the transmission member in response to the key depression.

While the present invention has been described with reference to the preferred embodiments, it is intended that the invention be not limited by any of the details of the description therein but includes all the embodiments which fall within the scope of the appended claims.

What is claimed is:

1. A keyboard device comprising:

a plurality of keys; and action mechanisms respectively provided corresponding to the plurality of keys, wherein each action mechanism comprises:

a transmission member which is displaced in response to a depression operation on a corresponding key;

a hammer member which provides an action load to the key subjected to the depression operation by making a motion in response to the displacement of the transmission member; and an interlock control section which has an interlock projecting section provided to one of the transmission member and the hammer member and a guide section which guides the interlock projecting section, and is provided to another one of the transmission member and the hammer member, for controlling the motion of the hammer member made in response to the displacement of the transmission member corresponding to the key subjected to the depression operation by a relative motion between the guide section and the interlock projecting section.

2. The keyboard device according to claim 1, wherein the guide section is a guide mount section formed at a portion in accordance with displacement of a relative distance between a hammer holding shaft at a rotation center of the hammer member and the interlock projecting section.

3. The keyboard device according to claim 1, wherein the guide section has a guide hole that engages with the interlock projecting section, and the guide hole is formed such that a length in a longitudinal direction is longer than a length in a direction orthogonal to the longitudinal direction.

4. The keyboard device according to claim 1, wherein the interlock projecting section comprises a rod-shaped projection body and a shock-absorbing section provided on an outer perimeter of the projection body.

5. The keyboard device according to claim 4, wherein the shock-absorbing section comprises a sliding projection which elastically slides along a guide edge portion of the guide section.

6. The keyboard device according to claim 1, wherein the interlock control section further comprises a shock-absorbing member provided to a portion of one of the transmission member and the hammer member, which comes in contact with the other of the transmission member and the hammer member.

7. The keyboard device according to claim 6, wherein an arc-shaped abutting section is provided to a portion that comes in contact with on the shock-absorbing section.

8. The keyboard device according to claim 1, wherein the interlock projecting section is provided to the transmission member, and the guide section is provided to the hammer member.

9. The keyboard device according to claim 8, wherein the guide section is a guide mount section formed at a portion in accordance with displacement of a relative distance between a hammer holding shaft at a rotation center of the hammer member and the interlock projecting section, and has a guide hole that engages with the interlock projecting section.

10. The keyboard device according to claim 8, wherein the interlock projecting section comprises a rod-shaped projection body and a shock-absorbing section provided on outer perimeter of the projection body.

11. The keyboard device according to claim 10, wherein the shock-absorbing section comprises a sliding projection which elastically slides along a guide edge portion of the guide section.

12. The keyboard device according to claim 8, wherein the interlock control section further comprises a shock-absorbing member provided to a portion of one of the transmission member and the hammer member, which comes in contact with the other of the transmission member and the hammer member.

13. The keyboard device according to claim 12, wherein an arc-shaped abutting section is provided to a portion that comes in contact with the shock-absorbing section.

14. The keyboard device according to claim 1, wherein the interlock projecting section is provided to the hammer member, and the guide section is provided to the transmission member.

15. The keyboard device according to claim 14, wherein the guide section is a guide mount section formed at a portion in accordance with displacement of a relative distance between a transmission holding shaft at a rotation center of the transmission member and the interlock projecting section, and has a guide hole that engages with the interlock projecting section.

16. The keyboard device according to claim 14, wherein the interlock projecting section comprises a rod-shaped projection body and a shock-absorbing section provided on an outer perimeter of the projection body.

17. The keyboard device according to claim 15, wherein the shock-absorbing section comprises a sliding projection which elastically slides along a guide edge portion of the guide section.

18. The keyboard device according to claim 14, wherein the interlock control section further comprises a shock-absorbing member provided to a portion of one of the transmission member and the hammer member, which comes in contact with the other of the transmission member and the hammer member.

19. The keyboard device according to claim 17, wherein an arc-shaped abutting section is provided to a portion that comes in contact with the shock-absorbing section.

20. A keyboard instrument comprising:

a keyboard device; and a sound source section which emits a musical sound in response to an operation on a key of the keyboard device, wherein the keyboard device comprises:

a plurality of keys; and action mechanisms respectively provided corresponding to the plurality of keys, and wherein each action mechanism comprises a transmission member which is displaced in response to a depression operation on a corresponding key;

a hammer member which provides an action load to the key subjected to the depression operation by making a motion in response to the displacement of the transmission member; and an interlock control section which has an interlock projecting section provided to one of the transmission member and the hammer member and a guide section which guides the interlock projecting section, provided to another one of the transmission member and the hammer member, for controlling the motion of the hammer member made in response to the displacement of the transmission member corresponding to the key subjected to the depression operation by a relative motion between the guide section and the interlock projecting section.

* * * * *